US009057998B2

(12) United States Patent
Yamazaki

(10) Patent No.: US 9,057,998 B2
(45) Date of Patent: Jun. 16, 2015

(54) PRINTER HAVING A POWER SAVING MODE

(71) Applicant: Masataka Yamazaki, Kuwana (JP)

(72) Inventor: Masataka Yamazaki, Kuwana (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 64 days.

(21) Appl. No.: 13/958,079

(22) Filed: Aug. 2, 2013

(65) Prior Publication Data

US 2014/0037317 A1 Feb. 6, 2014

(30) Foreign Application Priority Data

Aug. 3, 2012 (JP) ..... 2012-173400

(51) Int. Cl.
*G03G 15/00* (2006.01)
*G03G 15/01* (2006.01)

(52) U.S. Cl.
CPC ..... *G03G 15/5004* (2013.01); *G03G 15/0189* (2013.01); *G03G 15/5058* (2013.01); *G03G 2215/0158* (2013.01)

(58) Field of Classification Search
USPC ..... 399/49, 75, 82, 85
See application file for complete search history.

(56) References Cited

U.S. PATENT DOCUMENTS

| | | | | |
|---|---|---|---|---|
| 5,694,637 | A | 12/1997 | Yoshino et al. | |
| 5,872,586 | A | 2/1999 | Shio | |
| 8,682,196 | B2 * | 3/2014 | Tanaka | 399/85 |
| 8,831,460 | B2 * | 9/2014 | Hamada | 399/90 |
| 2004/0012694 | A1 | 1/2004 | Sato | |
| 2004/0100550 | A1 | 5/2004 | Bannai et al. | |
| 2005/0047834 | A1 | 3/2005 | Tomita et al. | |
| 2005/0226641 | A1 | 10/2005 | Ando et al. | |
| 2008/0043299 | A1 | 2/2008 | Ikeda | |

(Continued)

FOREIGN PATENT DOCUMENTS

| | | | |
|---|---|---|---|
| EP | 1 424 609 | A2 | 6/2004 |
| JP | 5-338328 | A | 12/1993 |
| JP | 8-310086 | A | 11/1996 |

(Continued)

OTHER PUBLICATIONS

Extended European search report dated Dec. 8, 2010 issued in EP 09252686.2 from related case, U.S. Patent No. 8,451,494 issued on May 28, 2013 to Yamazaki.

(Continued)

*Primary Examiner* — Quana M Grainger
(74) *Attorney, Agent, or Firm* — Scully, Scott, Murphy & Presser, PC

(57) ABSTRACT

A printer includes: a printing unit; a processor; and memory storing instructions that, when executed by the processor, causing the printer to perform operations comprising: shifting from a power supply mode to a power saving mode in case that a shift condition from the power supply mode to the power saving mode is met; executing a correction processing group that includes a first correction process in case that a first execution condition is met, and a second correction process unit in case that a second execution condition is met after the execution of the first correction process is completed; and delaying the shifting from the power supply mode to the power saving mode until completion of the second correction process, when both execution condition are met and when the execution of the first correction process has started and the execution of the second correction process is not completed.

8 Claims, 11 Drawing Sheets

(56) References Cited

U.S. PATENT DOCUMENTS

| | | | |
|---|---|---|---|
| 2010/0134813 | A1 | 6/2010 | Yamazaki |
| 2010/0321711 | A1 | 12/2010 | Takahashi |

FOREIGN PATENT DOCUMENTS

| | | | |
|---|---|---|---|
| JP | 9-76558 | A | 3/1997 |
| JP | 10-3188 | A | 1/1998 |
| JP | 10-230665 | A | 9/1998 |
| JP | 2001-255968 | A | 9/2001 |
| JP | 2003-195603 | A | 7/2003 |
| JP | 2004-142250 | A | 5/2004 |
| JP | 2004-252172 | A | 9/2004 |
| JP | 2006-222569 | A | 8/2006 |
| JP | 2008-077066 | A | 4/2008 |
| JP | 2010-128283 | A | 6/2010 |
| JP | 2011-002669 | A | 1/2011 |

OTHER PUBLICATIONS

US Office Action dated Oct. 23, 2012 issued in related U.S. Patent No. 8,451,494, issued on May 28, 2013 to Yamazaki.
Notice of Allowance dated Apr. 30, 2013 issued in related U.S. Patent No. 8,451,494 issued on May 28, 2013 to Yamazaki.

* cited by examiner

| FIG. 9A |
| --- |
| FIG. 9B |

PRINTER HAVING A POWER SAVING MODE

CROSS-REFERENCE TO RELATED APPLICATION

This application claims priority from Japanese Patent Application No. 2012-173400 filed on Aug. 3, 2012, the entire subject matter of which is incorporated herein by reference.

TECHNICAL FIELD

This disclosure relates to a printer having a power saving mode in which power consumption is suppressed. Specifically, this disclosure relates to the control of shifting from a power supply mode to a power saving mode when a shift condition is satisfied.

BACKGROUND

In order to realize power saving, a printer shifts from a power supply mode to a power saving mode in which power supply to some components is reduced relative to the power supply mode and thus power consumption is suppressed.

A background printer has a power saving mode. The printer is configured to display a message indicating that shifting to a low power consumption mode is not possible when a user inputs shift instructions for shifting from a power supply mode to a low power consumption mode, during an operation of the printer having the low power consumption mode (corresponding to the power saving mode). In the power saving mode, power consumption in a standby state is suppressed.

SUMMARY

However, such printer has the following problem. That is, the printer executes a correction process to acquire a correction value for adjusting printing properties, one example of which is the misregistration of the position of the dynamic/static image, if needed. There are plural kinds of correction values, and some of the correction values are obtained by executing plural correction processes. For example, when there is a specific correction value that requires two correction processes, e.g., a first correction process and a second correction process, the accurate specific correction value is not obtained if the printer does not perform the second correction process in a state where the printer shifts to a power saving mode after the first correction process is completed. Even if the second correction process is performed when the printer returns to a power supply mode, the relation between the first correction process and the second correction process becomes tenuous, and the reliability of the specific correction value is deteriorated. As a result, since the first correction process is re-performed, the first correction process performed just before the printer shifts to the power saving mode is wasted, and the time until the printing starts is lengthened.

Accordingly, this disclosure provides at least a technology to determine suitable shift timing to the power saving mode in a printer having the power saving mode.

A printer of this disclosure comprises: a printing unit configured to print an image on a sheet; a processor; and memory storing instructions that, when executed by the processor, causing the printer to perform operations comprising: supplying power to respective component of the printer in a power supply mode and reducing power consumption in a power saving mode relative to in the power supply mode; shifting from the power supply mode to the power saving mode in case that a shift condition from the power supply mode to the power saving mode is met; executing a correction processing group that includes a first correction process to acquire a first correction value for adjusting printing properties of the printing unit in case that a first execution condition is met, and a second correction process to acquire a second correction value for adjusting the printing properties of the printing unit in case that a second execution condition is met after the execution of the first correction process is completed; and delaying the shifting from the power supply mode to the power saving mode until completion of the second correction process, in case that the shift condition is met, when the first execution condition and the second execution condition are met and when the execution of the first correction process has started and the execution of the second correction process is not completed.

The printer disclosed in the description has the power supply mode and the power saving mode, in which the power supply states are different from each other. Further, as the correction processes executed by the printer, there are the first correction process that is executed in case that the first execution condition is met and the second correction process that is executed in case that the second execution condition is met after the execution of the first correction process is completed. Further, in case that the shift condition for shifting from the power supply mode to the power saving mode is met when the first execution condition and the second execution condition are met and when the execution of the first correction process has started and when the execution of the second correction process is not completed, the printer starts the execution of the second correction process after completion of the first correction process if the execution of the second correction process has not yet started, and thus shifts to the power saving mode after completion of the second correction process. The execution condition may correspond to, for example, a case where the elapsed time since the final operation or the elapsed time since the final printing is equal to or more than a threshold value. The correction process may correspond to, for example, misregistration correction or density correction. The execution condition of the respective correction processes may be user instructions, the number of printed pages that is equal to or larger than a threshold value, change of the environment, such as temperature, or detection of exchange of consumable materials. The first correction process may be independently executed.

The second correction value is a specific correction value that is obtained by executing the first correction process and the second correction process as a set. In the printer disclosed in the description, in case that the shift condition to the power saving mode is met when the first execution condition and the second execution condition are met and when the first correction process has started, acquiring of the second correction value by completing the second correction process can reduce the number of executions of the first correction process and the waste, as compared with a case where the first correction process is re-performed after the printer returns to the power supply mode without completing the second correction process. Accordingly, the printer shifts to the power saving mode after completion of the second correction process.

According to this disclosure, it is achieved the technology which determines the suitable shift timing to the power saving mode in the printer having the power saving mode.

BRIEF DESCRIPTION OF THE DRAWINGS

The foregoing and additional features and characteristics of this disclosure will become more apparent from the following detailed descriptions considered with the reference to the accompanying drawings, wherein.

DETAILED DESCRIPTION

Hereinafter, illustrative embodiments that specify a printer according to this disclosure will be described in detail with reference to the accompanying drawings. This disclosure is applied to an electrophotographic color printer.

[Overall Configuration of the Printer]

Figure 1:
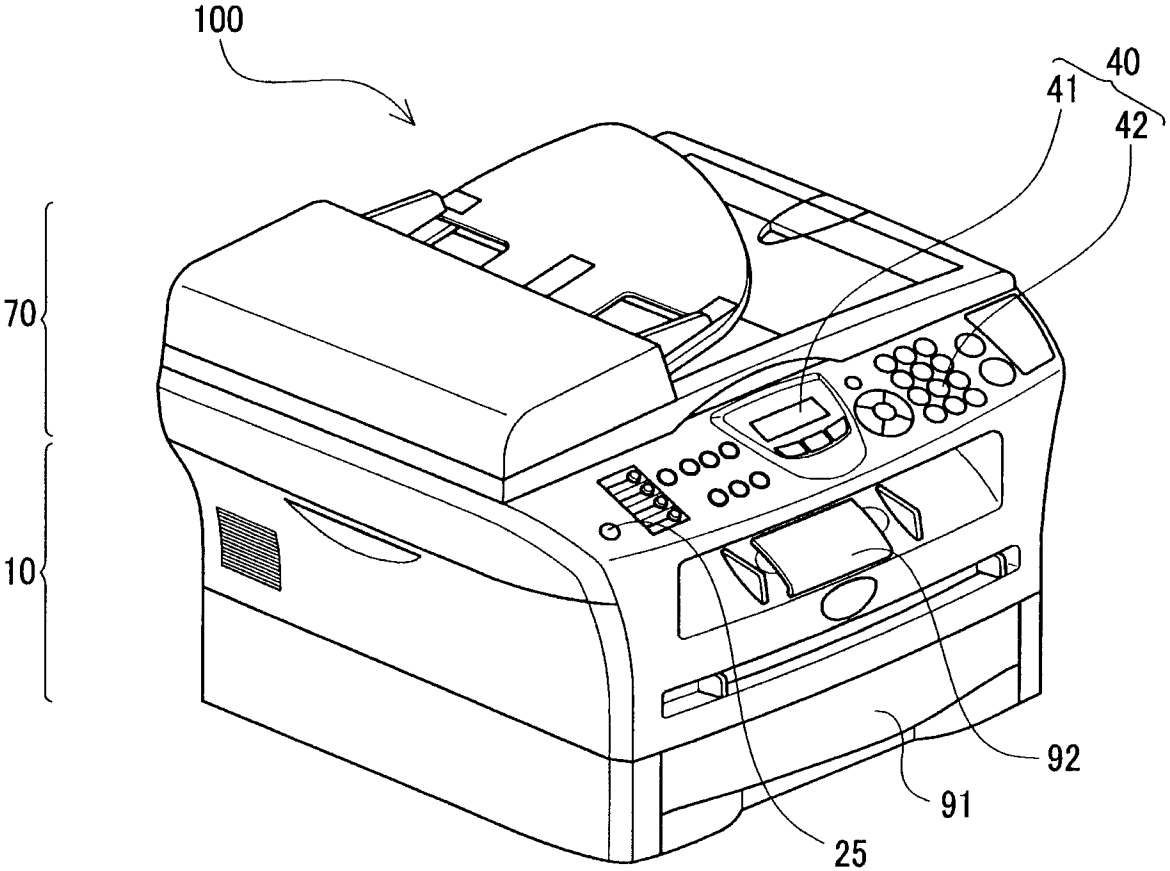
FIG. 1 is a perspective view illustrating an external appearance of a printer according to an illustrative embodiment.

As illustrated in FIG. 1, a printer 100 includes an image forming unit 10 (an example of a printing unit) performing printing, an image reading unit 70 reading an image of a document, a feed tray 91 accommodating sheets before printing, and a discharge tray 92 accommodating sheets after printing. Further, on an upper surface of the image forming unit 10, an operation panel 40, which includes a display unit 41 including a liquid crystal display and a button group 42 composed of an OK button, a cancel button, ten keys, and a user authentication button, is provided. By this operation panel 40, display of operation situation or user's input operation becomes possible.

Further, on the upper surface of the image forming unit 10, a power switch 25 switching a power supply state is provided separately from the button group 42 of the operation panel 40. As modes for the power supply state, the printer 100 has a power supply mode, in which power is supplied to all components, and a power saving mode, in which power supply to some components is limited to suppress power consumption. If the power switch 25 is pressed by a user, the printer 100 shifts from the power supply mode to the power saving mode, or shifts from the power saving mode to the power supply mode. The details of the respective modes will be described later.

[Configuration of the Image Forming Unit of the Printer]

Figure 2:
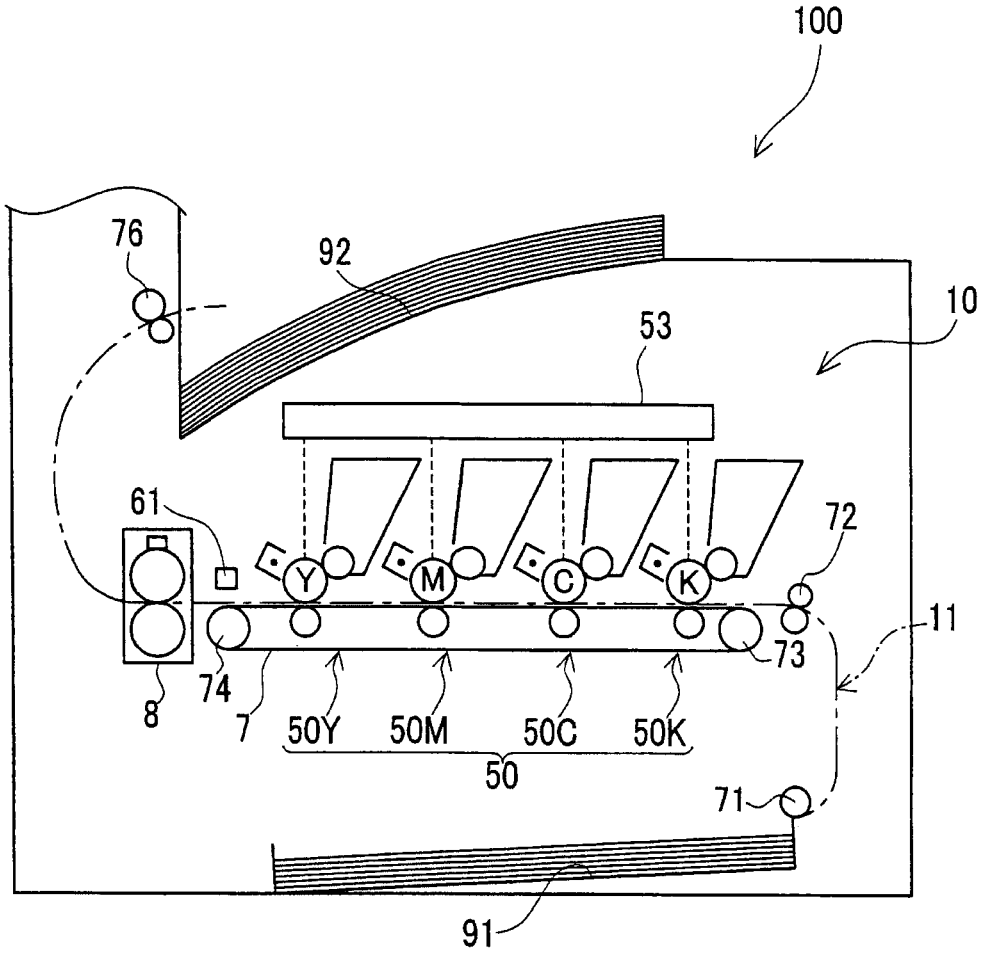
FIG. 2 is a cross-sectional view illustrating the internal configuration of the printer shown in FIG. 1.

Next, the configuration of an image forming unit 10 of a printer 100 will be described with reference to FIG. 2. The image forming unit 10 includes a processing unit 50 which forms a toner image in an electrophotographic method and transfers the toner image to a sheet, and a fixing device 8 which fixes the non-fixed toner on the sheet. Further, on the lower side of the image forming unit 10, a feed tray 91, on which a sheet before image transferring is put, is provided, and on the upper side of the image forming unit 10, a discharge tray 92, on which a sheet after the image transferring is put, is provided.

Further, the image forming unit 10 includes an exposure device 53 which irradiates respective processing units 50Y, 50M, 50C, and 50K with light, a conveyance belt 7 which conveys the sheet to a transfer position of the respective processing units 50Y, 50M, 50C, and 50K, and a mark sensor 61 which detects a pattern image formed on the conveyance belt 7.

Further, in the printer 100, a substantially S-shaped conveyance path 11 (a dot and dash line in FIG. 2) is provided so that the sheet, which is accommodated in the feed tray 91 positioned on the bottom portion thereof, passes through a feed roller 71, a resistance roller 72, the processing unit 50, and the fixing device 8, and is guided to the discharge tray 92 that is positioned on the upper portion thereof.

The processing unit 50 can form a color image, and includes processing units which correspond to respective colors of yellow (Y), magenta (M), cyan (C), and black (K), and are arranged in parallel. Specifically, the processing unit 50 includes a processing unit 50Y which forms an image of Y color, a processing unit 50M which forms an image of M color, a processing unit 50C which forms an image of C color, and a processing unit 50K which forms an image of K color. The respective processing units 50Y, 50M, 50C, and 50K are arranged to be spaced apart from each other for a predetermined distance in the conveyance direction of the sheet.

In the processing unit 50, the surface of a photosensitive conductor is uniformly charged by a charge device. Thereafter, the surface of the photosensitive conductor is exposed by light from the exposure device 53, and an electrostatic latent image of the image to be formed on the sheet is formed. Then, through a developing device, toner is supplied to the photosensitive conductor. As a result, the electrostatic latent image on the photosensitive conductor becomes a visible image as a toner image.

The conveyance belt 7 is an endless belt member that is put on conveyance rollers 73 and 74, and is made of a resin material, such as polycarbonate. As the conveyance roller 74 is rotated, the conveyance belt 7 is circulated to the space counterclockwise direction. Accordingly, the sheet that is put on the upper surface thereof is conveyed from the side of the resistance roller 72 to the side of the fixing device 8.

The image forming unit 10 extracts the sheets put on the feed tray 91 one by one and conveys the sheets onto the conveyance belt 7. Further, the image forming unit 10 transfers the toner image, which is formed by the processing unit 50, to the sheet. As for color printing, toner images are formed by the respective processing units 50Y, 50M, 50C, and 50K, and overlap each other on the sheet. On the other hand, as for the monochrome printing, a toner image is formed only by the processing unit 590K, and is transferred to the sheet. Thereafter, the sheet to which the toner image is transferred is conveyed to the fixing device 8, and the toner image is thermally fixed to the sheet. Then, the sheet after fixing is discharged to the discharge tray 92.

Further, a mark sensor 61 is positioned on the downstream side than the processing units 50Y, 50M, 50C, and 50K and on the upstream side than the fixing device in the conveyance direction of the sheet, and detects a pattern for image adjustment that is formed on the conveyance belt 7.

Figure 3:
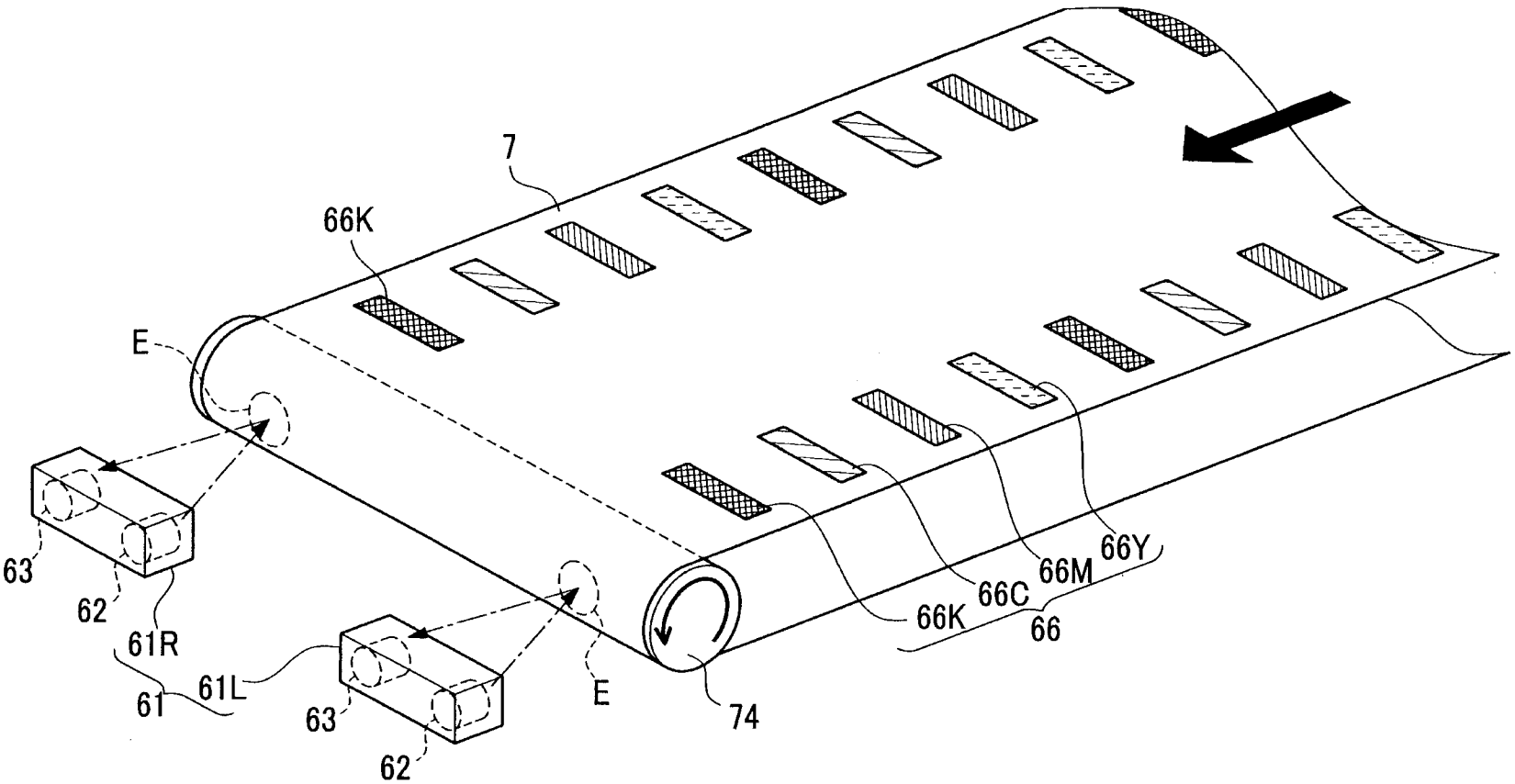
FIG. 3 is a view illustrating an arrangement of a mark sensor.

Specifically, as illustrated in FIG. 3, the mark sensor 61 is composed of two sensors: a sensor 61R that is arranged on the right side and a sensor 61L that is arranged on the left side in the width direction of the conveyance belt 7. Each of the sensors 61R and 61L is a reflection type optical sensor, in which a light emitting element 62 (e.g., LED) and a light receiving element 63 (e.g., LED) are to be a pair. The mark sensor 61 is configured so that the light emitting element 62 emits light in a slanting direction against the surface of the conveyance belt 7 (dotted frame E in FIG. 3), and the light receiving element 63 receives the light. Due to a difference between a light reception amount when the mark 66 for image adjustment (the mark 66 in FIG. 3 is an example of a mark for correcting static misregistration) passes and a light reception amount that is directly received from the conveyance belt 7, the mark for image adjustment can be detected.

[Correction Process of the Printer]

Next, various kinds of correction processes executed by the printer 100 will be described. The printer 100 executes respective correction processes, such as dynamic misregistration correction, static misregistration correction, developing bias correction, and gamma correction, in accordance with the execution conditions of the respective correction processes. On the other hand, such correction processes are exemplary. The correction processes are not limited thereto, and other correction processes may be executed.

Figure 4:
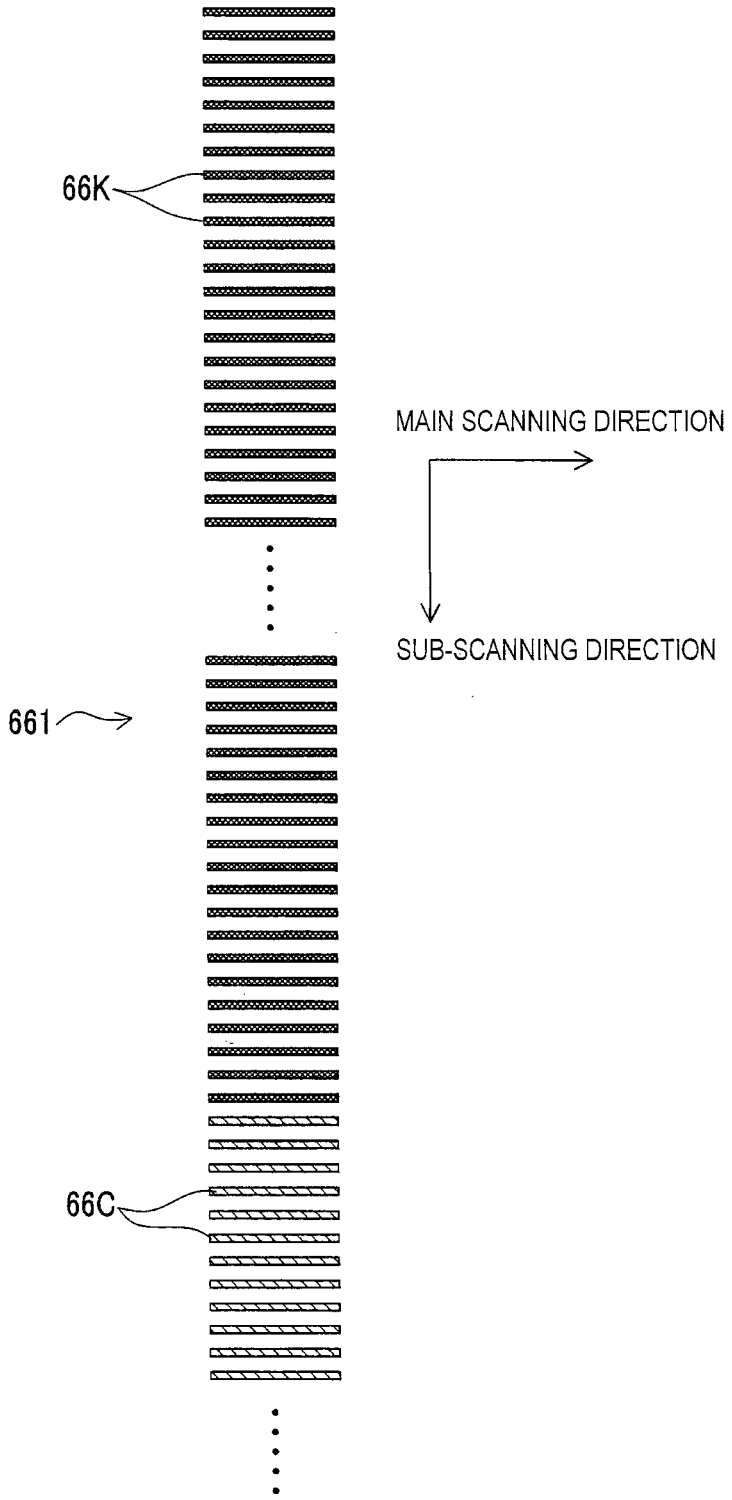
FIG. 4 is a view illustrating an example of a mark that is formed for dynamic misregistration correction.

The dynamic misregistration correction is a process for acquiring a correction value for adjusting the misregistration of the position of the dynamic image having a specific period, which is due to eccentricity of the photosensitive conductor or the conveyance rollers 73 and 74 and abnormality of the pitch of a gear that rotates them. For the dynamic misregistration correction, the printer 100 forms marks 66K and 66C shown in FIG. 4 as marks 661 for correcting the dynamic misregistration. Although FIG. 4 illustrates black and cyan, the marks are formed in the same manner with respect to magenta and yellow. Specifically, respective color marks that are elongated in a main scanning direction are arranged side by side in a sub-scanning direction by colors. The mark sensor 61 reads these marks, and acquires a periodic misregistration amount (correction value) by calculating a gap between the respective marks.

Figure 5:
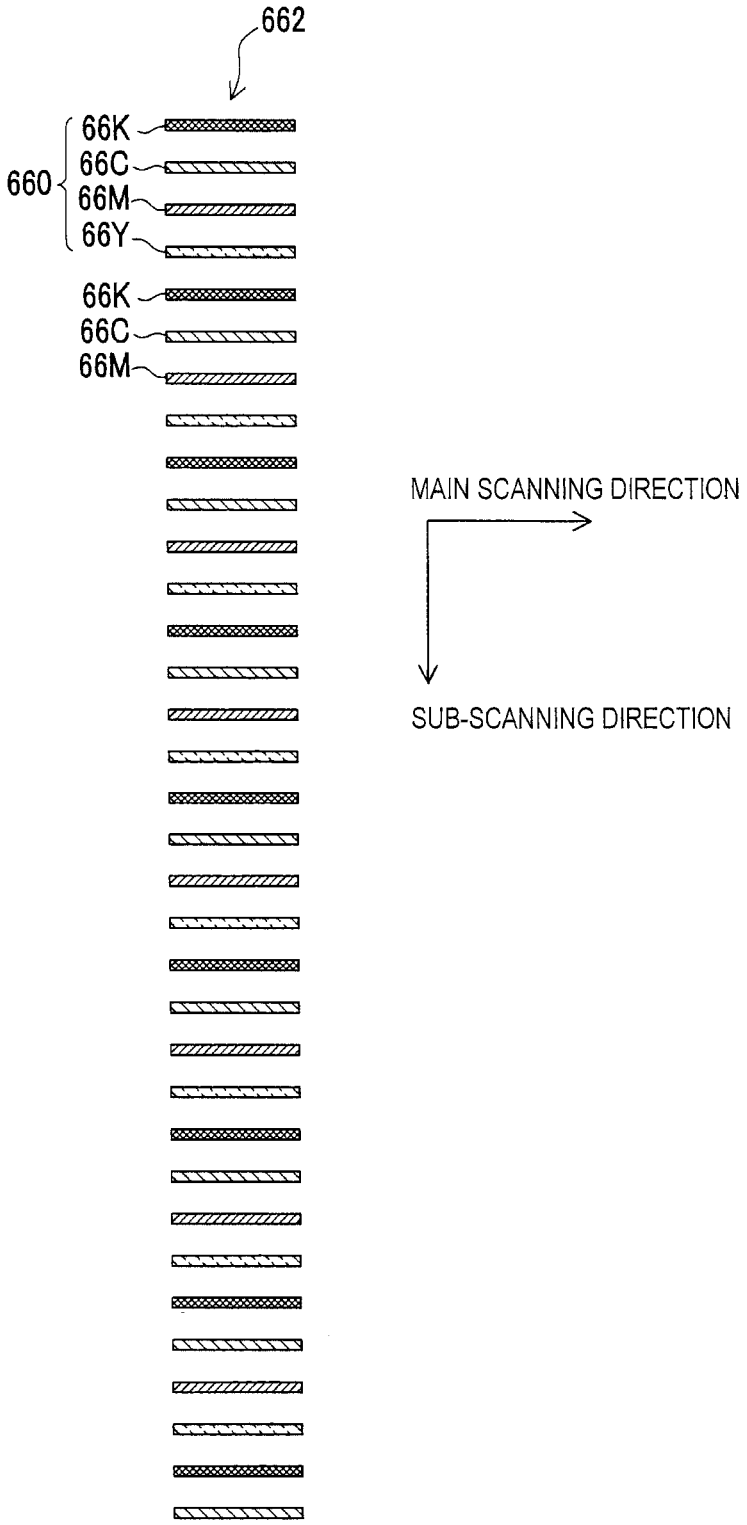
FIG. 5 is a view illustrating an example of a mark that is formed for static misregistration correction.

The static misregistration correction is a process for acquiring a correction value for adjusting the misregistration of the position of the static image that does not have a specific period, which is due to the misregistration of the attachment position of the photosensitive conductor or the exposure device 53. For the static misregistration correction, the printer 100 forms a mark group 660 that includes a set of marks 66K, 66C, 66M, and 66Y as shown in FIG. 5 as the marks 662 for correcting the static misregistration. Specifically, respective color marks that are elongated in a main scanning direction are arranged side by side in a sub-scanning direction by mark groups 660. The mark sensor 61 reads these marks, and acquires a misregistration amount (correction value) between the colors by calculating a gap between the respective marks.

The developing bias correction is a process for acquiring a correction value for adjusting the misregistration between an ideal density that is specified by the printer 100 and the density of the mark that is actually formed. For the developing bias correction, the printer 100 form marks of a predetermined density (e.g., 100%) by colors. The mark sensor 61 reads these marks, and acquires a correction value of the bias for proximity to the ideal density by calculating the actual density based on the light reception amount.

The gamma correction is a process for correcting the mismatch between an instructed density (instructed gradation) by an external computer or an output density of the image reading unit 70 and an output density of the printer 100 itself. For the gamma correction, the printer 100 forms a plurality of marks having different densities at predetermined density intervals (e.g., 20%) by colors. The mark sensor 61 reads the marks, specifies the change characteristics of the density of each color from the relative relationship in density between the marks, and prepares a relative relationship table between the change characteristics and the instructed gradation of the external computer. In the following description, the gamma correction for correcting the misregistration with the instructed density from the external computer is simply called "gamma correction", and the gamma correction for correcting the misregistration with the output density of the image reading unit 70 is simply called "copy gamma correction".

A plurality of correction process execution conditions are provided by correction processes. In the plurality of correction processes, the same execution condition may be set, or the plurality of correction processes may meet the execution condition at the same time. Further, the correction process execution timing may differ for each execution condition. For example, in case that the execution condition is a cover open, power supply input, or user instructions, the execution timing becomes an immediate time when the execution condition is met. Further, in case that the execution condition is the print number of sheets, continuous starting time, or the change of the environment, such as temperature and humidity, in the printer, the execution timing is to be a time before printing the job executed after the execution condition is met.

If the density of each mark has the mismatch, although the mark is a mark formed on the same image forming position, non-uniformity occurs in the read light reception amount by the mark sensor 61 Thus, even in the gamma correction, it becomes difficult to detect the characteristic change of the density of each color with good accuracy. Accordingly, when the gamma correction is executed, the developing bias corrections are executed as a set, and the developing bias correction is executed prior to the gamma correction. In the same manner as the gamma correction, the copy gamma correction is executed with the developing bias correction as a set, and the developing bias correction is executed prior to the copy gamma correction.

Further, if there is the dynamic misregistration in the image forming position, it becomes difficult to detect the static misregistration with good accuracy. Accordingly, in the case of executing the static misregistration correction, the dynamic misregistration corrections are executed as a set, and the dynamic misregistration correction is executed prior to the static misregistration correction.

Figure 6:
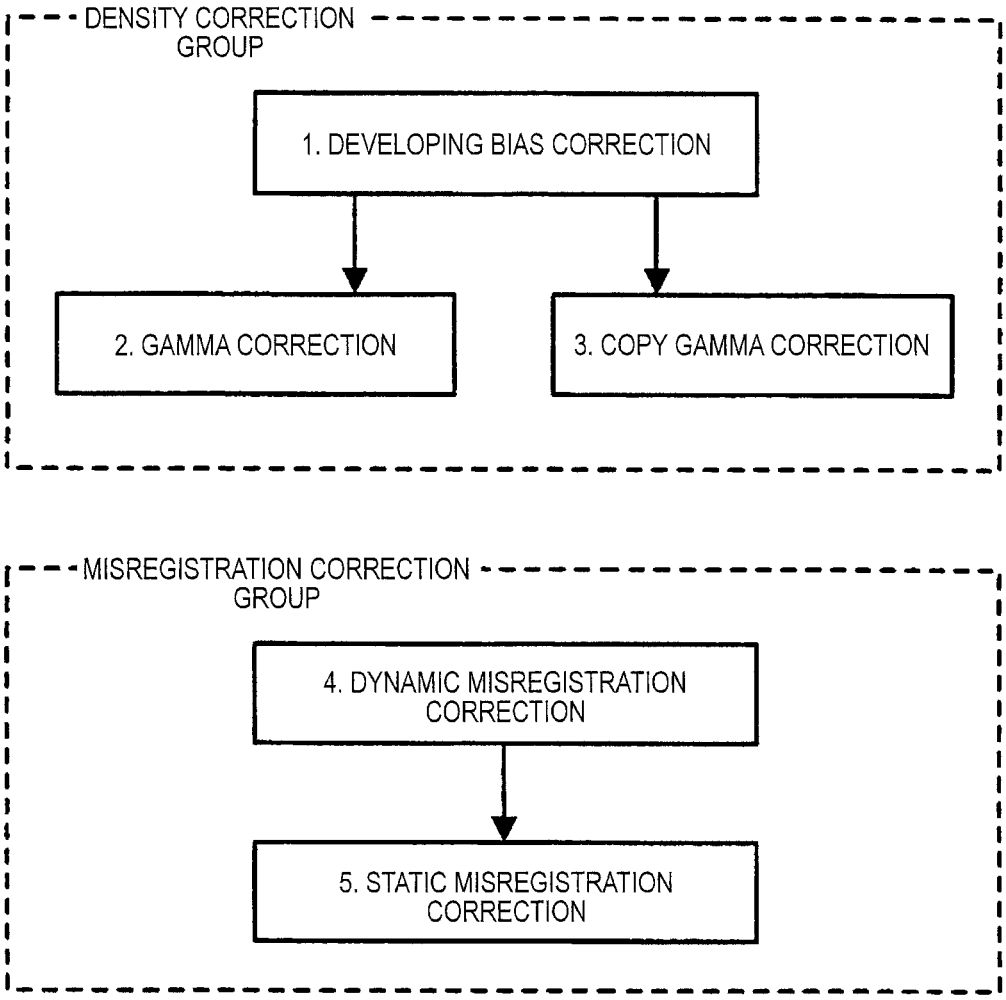
FIG. 6 is a diagram illustrating a priority of correction processes and a group (part 1)

FIG. 6 shows a priority execution order when the group configuration of each correction process and each correction process meet the execution condition at the same time. As described above, the gamma correction and the copy gamma correction are the premise that the developing bias correction is executed. Accordingly, if the execution condition of the gamma correction or the copy gamma correction is met, the execution condition of the developing bias correction is also met at the same time. That is, in this illustrative embodiment, the developing bias correction and the gamma correction or the copy gamma corrections configure a group. Although any one of the gamma correction and the copy gamma correction may be first executed, in this illustrative embodiment, the gamma correction is first executed. The developing bias correction can be independently executed, and even if the execution condition of the developing bias correction is met, it may not meet the execution condition of the gamma correction or the copy gamma correction.

Further, as described above, the static misregistration correction is a premise that the dynamic misregistration correction is executed. Accordingly, if the execution condition of the static misregistration correction is met, the execution condition of the dynamic misregistration correction is also met at the same time. That is, in this illustrative embodiment, the static misregistration correction and the dynamic misregistration correction configure a group. The dynamic misregistration correction can be independently executed, and even if the execution condition of the dynamic misregistration correction is met, it may not meet the execution condition of the static misregistration correction.

If the developing bias correction and the gamma correction (or the copy gamma correction) (hereinafter referred to as "density correction group") and the dynamic misregistration correction and the static misregistration correction (hereinafter referred to as "misregistration correction group") meet the execution condition at the same time, it is preferable to first perform the density correction group. That is, if it is unable to form a mark with sufficient density, there is a possibility that the mark for the misregistration is unable to be detected. Accordingly, in this illustrative embodiment, by performing the density correction group first, the accuracy deterioration of the respective correction processes of the misregistration correction group is suppressed.

[Electrical Configuration of the Printer]

Figure 7:
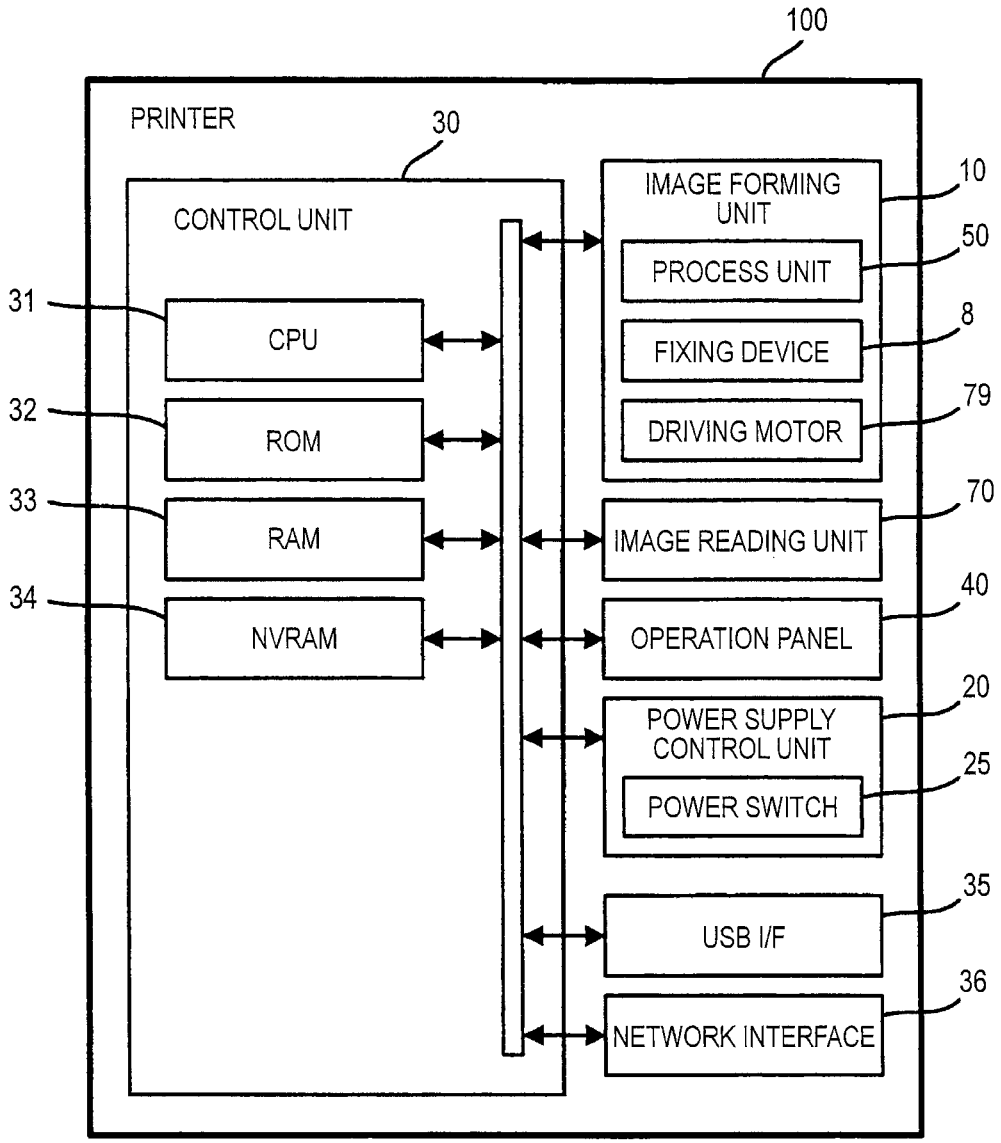
FIG. 7 is a block diagram illustrating an electrical configuration of a printer according to an illustrative embodiment.

Next, the electrical configuration of the printer 100 will be described. The printer 100, as shown in FIG. 7, includes an image forming unit 10, an image reading unit 70, an operation panel 40, a power supply control unit 20 (an example of an execution unit) controlling power supply to various kinds of components, a control unit 30 controlling the image forming unit 10, a USB interface 35 that is a communication interface for connecting to an external device, and a network interface 36. On the other hand, a power switch 25 is included in the power supply control unit 20.

The control unit 30 includes a CPU 31, a ROM 32, a RAM 33, and a nonvolatile RAM (NVRAM) 34. In the ROM 32, firmware that is a control program for controlling the printer 100, various settings, and initial values are stored. The RAM 33 is used as a work area in which various control programs are loaded or a storage area where image data is temporarily stored.

The CPU 31 (example of a processor that functions as the execution unit, the correction unit, and the control unit) controls the respective components of the printer 100 while storing the processing result in the RAM 33 or NVRAM 34 in accordance with the control program read from the ROM 32 (example of memory) or signals sent from the various sensors.

The USB interface 35 is an interface that enables communication with another device. If a USB memory is connected to the USB interface 35, the printer 100 reads and outputs image data that is stored in the USB memory. A connection destination of the USB interface 35 is not limited to the USB memory, but may be, for example, a personal computer (PC).

In the same manner as the USB interface 35, the network interface 36 is an interface that enables communication with another device. In the same manner as the USB interface 35, the printer 100 may receive and output the image data from the external device that is connected through the network interface 36.

The image forming unit 10 includes components that print an image on the sheet, and includes the above-described processing unit 50, the fixing device 8, and various rollers that convey the sheet. The image forming unit 10 also includes the driving motor 79 that drives various rollers.

[Power Supply Control]

Next, the power supply control of the printer 100 will be described. The printer 100 has a power saving mode in which power supply to at least the image forming unit 10 is limited to reduce power consumption and a power supply mode in which power is supplied to the whole power system. In the power supply mode, the power is supplied to the image forming unit 10, the control unit 30, the operation panel 40, the external interface, and the power switch 25, and the printing operation can be performed. Just after the start of the printer 100, the printer 100 operates in the power supply mode.

If the condition for shifting to the power saving mode is met while the printer is being operated in the power supply mode, the printer shifts to the power saving mode. In the power saving mode, the power supply to the image forming unit 10, the control unit 30, the operation panel 40, and the external interface is interrupted. As a result, the printing operation cannot be performed, and the power consumption is lower than the power supply mode. The shifting of the power supply to the various components is performed by the power supply control unit 20. Even in the power saving mode, the power supply to the power supply control unit 20 continues. The power supply control unit 20 has a sensor for detecting an on/off state of the power switch 25, and even in the power saving mode, the power supply control unit 20 accepts a user's operation of the power switch 25. If the power switch 25 is pressed while the printer is being operated in the power saving mode, the printer resumes the power supply to all components including the control unit 30, and shifts to the power supply mode.

In this illustrative embodiment, three shifting conditions for the printer 100 to shift from the power supply mode to the power saving mode are pressing of the power switch 25, reception of a shift command from an external device such as a PC, and reception of a timer event that issues at a time that is set as a shift time. If even one of them is met, the printer shifts from the power supply mode to the power saving mode. In the power saving mode, the power is not supplied to the external interface or the operation panel 40, and only the pressing of the power switch 25 becomes the shift condition for the printer 100 to shift from the power saving mode to the power supply mode.

[Power Saving Mode Shift Control]

Next, the timing control for shifting to the power saving mode will be described. In particular, the shift timing to the power saving mode in case that the shift condition to the power saving mode is met during the execution of the correction process will be described.

As described above, the marks are formed on the conveyance belt 7 in the correction process, and if the correction process is stopped midway, the formed marks become useless. Accordingly, if the shift condition to the power saving mode is met during the correction process, the printer 100 shifts to the power saving mode at least after completion of the correction process.

Further, in the printer 100, the correction processing group is prescribed to executes a plurality of correction processes as a set, as described above. In this case, if the shift condition to the power saving mode is met during the execution of the previously executed correction process, if the printer 100 completes the previously executed correction process, but does not execute the correction process to be executed subsequently, the correction value of the correction processing group is not obtained. Accordingly, even if the subsequent correction process is executed after the printer 100 returns to the power supply mode, by using the correction value of the previous correction process that is executed just before the printer 100 shifts to the power saving mode, the relationship between the both correction processes becomes, and the reliability of the correction value which obtained from the subsequent correction process is deteriorated. Although the correction processing group can be re-performed from the beginning after the printer 100 returns to the power supply mode, the previous correction process performed just before the printer shifts to the power saving mode is wasted.

Accordingly, if the shift condition to the power saving mode is met during the execution of the correction processing group, the printer shifts to the power saving mode after all the correction processes of the correction processing group are completed. That is, even in case that the shift condition to the power saving mode is met during the execution of the previous correction process, or even in case that the shift condition to the power saving mode is met during the execution of the subsequent correction process, the printer shifts to the power saving mode after the both correction processes are completed.

In case that the shift condition to the power saving mode is met during the execution of one correction processing group, even if the execution condition of another correction processing group is met, the printer shifts to the power saving mode after the execution of the one correction processing group without executing the another correction processing group. In this case, since the another correction processing group is not executed just before the shift to the power saving mode, although the another correction processing group is executed after the printer returns to the power supply mode, the number of executions is not changed. That is, useless correction process does not occur, and the printer may rapidly shift to the power saving mode.

On the other hand, if the shift condition to the power saving mode is met during a printing process, the printer may shift to the power saving mode after completion of the printing process, or the printer may stop the printing process and rapidly shift to the power saving mode. Further, in case that neither the correction process nor the printing process is being performed when the shift condition to the power saving mode is met, the printer rapidly shifts to the power saving mode.

Figure 8:
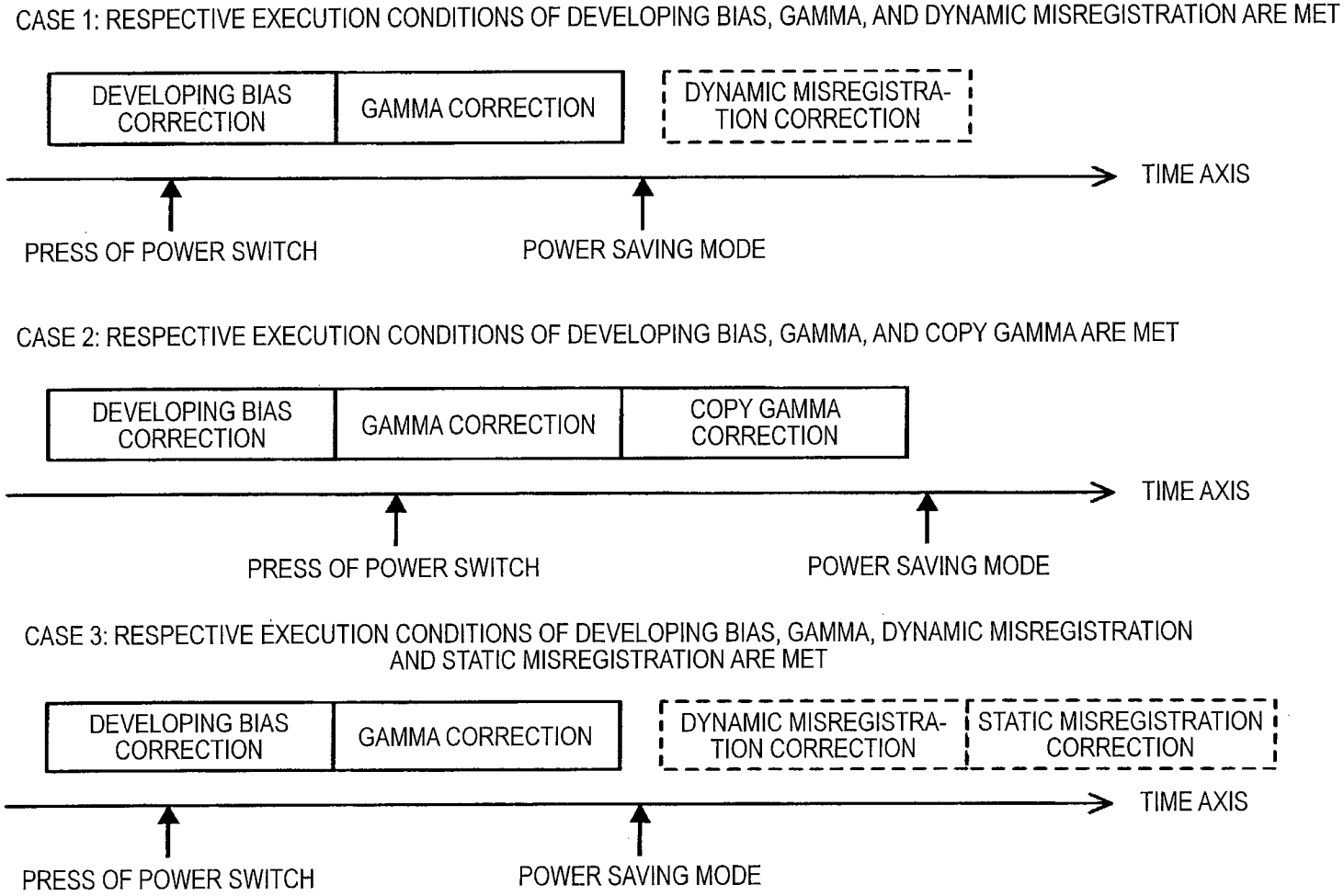
FIG. 8 is a diagram illustrating examples of press timing of a power, switch, shift timing to a power saving mode, and a correction process execution situation.

FIG. 8 illustrates an example of timing of shifting to the power saving mode in case that the execution conditions of the plurality of correction processes are met and the power switch 25 is pressed during the execution of any one of the plurality of correction processes in the printer 100.

Case 1 in FIG. 8 shows a situation where the power switch 25 is pressed during the execution of the developing bias correction in a state where the respective execution conditions of the developing bias correction, the gamma correction, and the dynamic misregistration correction are met. In Case 1, the developing bias correction and the gamma correction configure a correction processing group to be executed as a set. In Case 1, firstly, the printer completes the developing bias correction being executed. Since the next gamma correction is a correction process of the same group as with the developing bias correction, and the developing bias correction has started, the gamma correction is also executed before shifting to the power saving mode. Since the subsequent dynamic misregistration correction is a correction process of a different group from the developing bias correction and the gamma correction and the execution thereof has not started at the time when the power switch 25 is pressed, the dynamic misregistration correction is not executed. Accordingly, the printer shifts to the power saving mode after completion of the gamma correction. In case 1 in FIG. 8, processes of a power saving mode shift process, which will be described later, are performed in order of S101, S102(YES), S121(YES), S122, S101, S102(NO), S103(NO), S104(NO), and S105.

Case 2 in FIG. 8 shows a situation where the power switch 25 is pressed during the execution of the gamma correction after completion of the developing bias correction in a state where the respective execution conditions of developing bias correction, gamma correction, and copy gamma correction are met. In Case 2, the developing bias correction and the gamma correction configure a correction processing group to be executed as a set, and the developing bias correction and the copy gamma correction configures a correction processing group to be executed as a set. In Case 2, firstly, the printer completes the gamma correction being executed. Accordingly, the correction processing group of the developing bias correction and the gamma correction is to be completed. Since the subsequent copy gamma correction is a correction process of the same group as the developing bias correction, and the developing bias correction is completed, so that the copy gamma correction is also executed. Accordingly, the printer shifts to the power saving mode after completion of the copy gamma correction. In case 2 in FIG. 8, processes of a power saving mode shift process, which will be described later, are performed in order of S101, S102(No), S103(YES), S131(YES), S101, S102(NO), S103(NO), S104(NO), and S105.

Case 3 in FIG. 8 shows a situation where the power switch 25 is pressed during the execution of the developing bias correction in a state where the respective execution conditions of the developing bias correction, the gamma correction, dynamic misregistration correction, and the static misregistration correction are met. In Case 3, the developing bias correction and the gamma correction configure a correction processing group to be executed as a set, and the dynamic misregistration correction and the static misregistration correction configure a correction processing group to be executed as a set. In Case 3, in the same manner as Case 1, the developing bias correction being executed is first completed. Since the developing bias correction has started, the subsequent gamma correction is also executed. Since the next dynamic misregistration correction and the static misregistration correction are correction processes of a different group from the developing bias correction and the execution thereof has not started at the time when the power switch 25 is pressed, the dynamic misregistration correction and the static misregistration correction are not executed. Similarly, even if the power switch 25 is pressed during executing the gamma correction, the dynamic misregistration correction and the static misregistration correction are not to be executed. Accordingly, the printer shifts to the power saving mode after completion of the gamma correction. In case 3 in FIG. 8, processes of a power saving mode shift process, which will be described later, are performed in the order of S101, S102 (YES), S121(YES), S122, S101, S102(NO), S103(NO), S104(YES), S141(NO), and S105.

[Power Saving Mode Shift Process]

Figures 9, 9A:
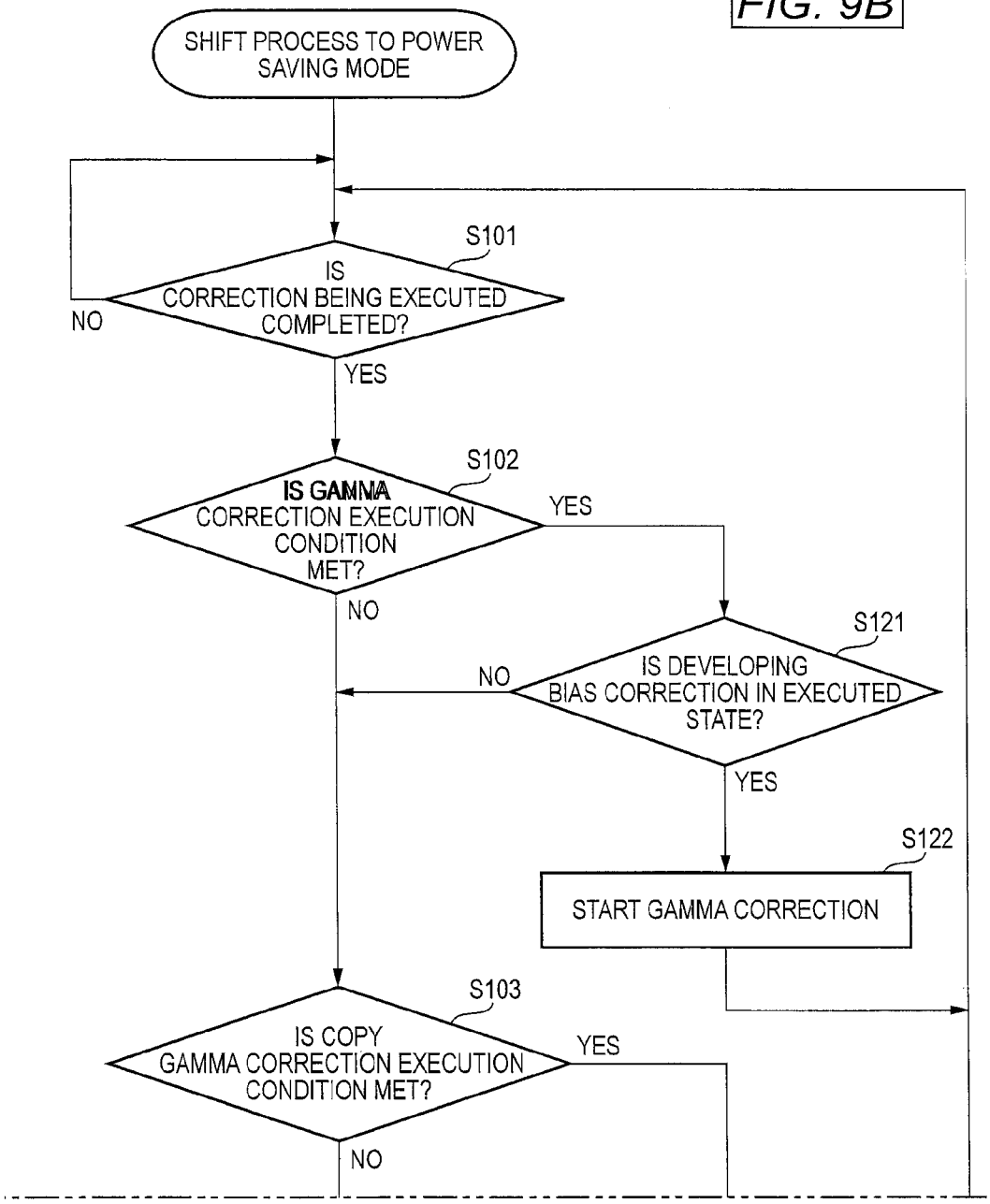
FIGS. 9A and 9B are flowcharts illustrating the procedure of the power saving mode shift process.
Figure 9B:
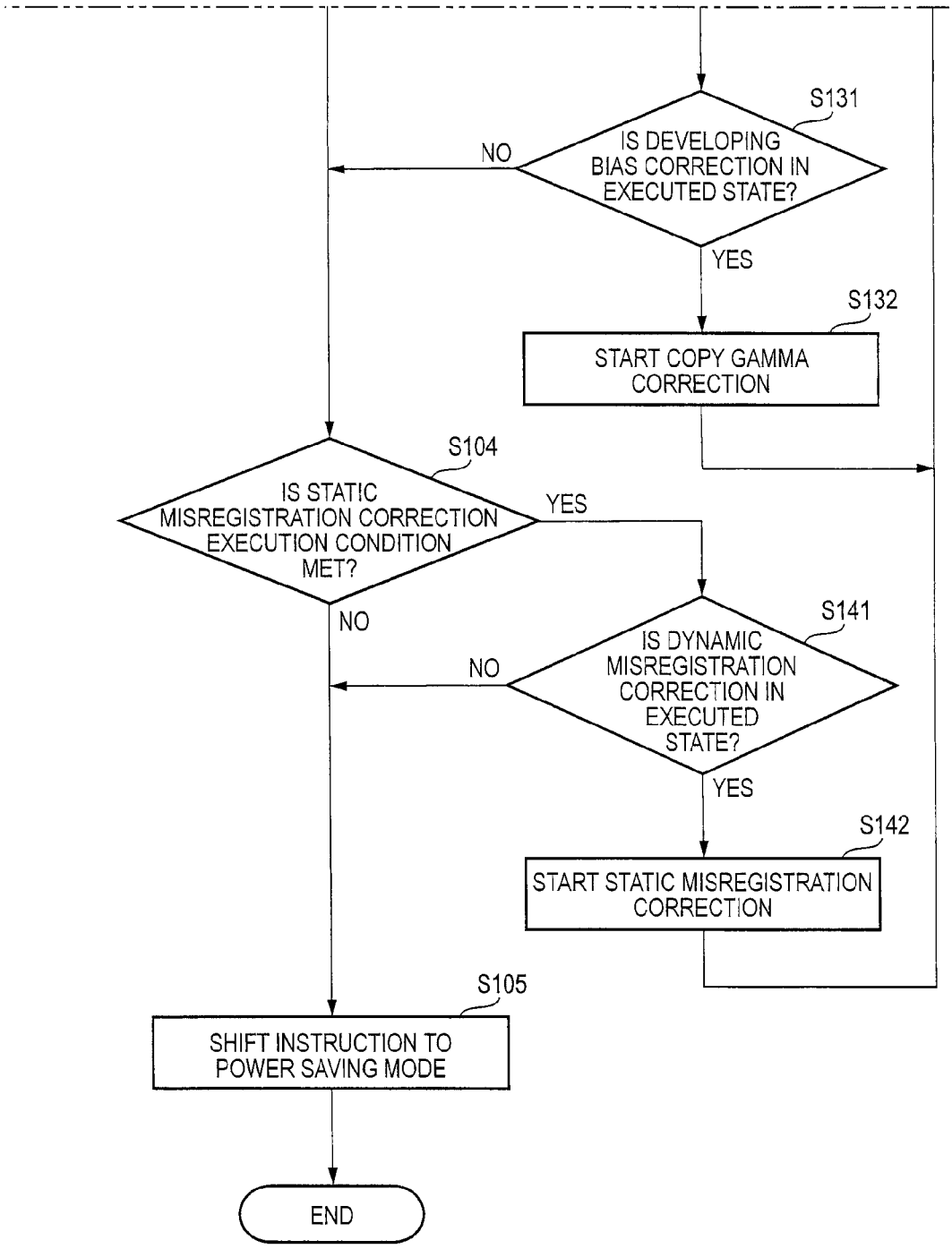

Hereinafter, a power saving mode shift process that realizes the above-described timing control for shifting to the power saving mode will be described with reference to the flowcharts of FIGS. 9A and 9B. The power saving mode shift process is executed by the CPU 31 when the shift condition to the power saving mode is met during the execution of the correction process.

According to the power saving mode shift process, it is first determined whether the correction process being executed is completed (S101). If the correction process is not completed (NO in S101), the CPU 31 waits for the completion of the correction process. That is, even if the shift condition to the power saving mode is met during the execution of the correction process, the CPU 31 completes the correction process being executing first.

If the correction process is completed (YES in S101), it is determined whether the execution condition of the gamma correction is met (S102). If the execution condition of the gamma correction is met (YES in S102), it is determined whether the developing bias correction have been executed (hereinafter referred to as an "executed state") (S121). The "executed state" in S121 means a state where irrespective of whether the shift condition to the power saving mode is met or not, the developing bias correction is successively executed together with other correction processes and the execution thereof is completed up to now. In other words, if it is determined that the developing bias correction and another related correction have been successively executed, it is determined as the executed state.

Since the gamma correction configures a group with the developing bias correction as a set, if the developing bias correction is in an executed state (YES in S121), the execution of the gamma correction starts (S122). After S122, the processing proceeds to S101 and waits for completion of the gamma correction. On the other hand, if the developing bias correction is not in the executed state (NO in S121), the execution of the gamma correction does not start. Accordingly, the processing proceeds to S103 without executing the gamma correction even if the execution condition of the gamma correction is met.

If the execution condition of the gamma correction is not met (NO in S102), or if the developing bias correction is not in the executed state (NO in S121), it is determined whether the execution condition of the copy gamma correction is met (S103). If the execution condition of the copy gamma correction is met (YES in S103), it is determined whether the developing bias correction is in the executed state (S131).

In the same manner as the gamma correction, since the copy gamma correction is a group with the developing bias correction as a set, if the developing bias correction is in the executed state (YES in S131), the execution of the copy gamma correction starts (S132). After S132, the processing proceeds to S101 and waits for completion of the copy gamma correction. On the other hand, if the developing bias correction is not in the executed state (NO in S131), the execution of the group including the copy gamma correction does not start. Accordingly, the processing proceeds to S104 without executing the copy gamma correction even if the execution condition of the copy gamma correction is met.

If the execution condition of the copy gamma correction is not met (NO in S103), or if the developing bias correction is not in the executed state (NO in S131), it is determined whether the execution condition of the static misregistration correction is met (S104). If the execution condition of the static misregistration correction is met (YES in S104), it is determined whether the dynamic misregistration correction is in the executed state (S141).

Since the static misregistration correction configures a group with the dynamic misregistration correction as a set, if the dynamic misregistration correction is in an executed state (YES in S141), the execution of the static misregistration correction starts (S142). After S142, the processing proceeds to S101 and waits for completion of the static misregistration correction. On the other hand, if the dynamic misregistration correction is not in the executed state (NO in S141), the execution of the static misregistration correction does not start. Accordingly, the processing proceeds to S105 without executing the static misregistration correction even if the execution condition of the static misregistration correction is met.

If the execution condition of the static misregistration correction is not met (NO in S104), or if the dynamic misregistration correction is not in the executed state (NO in S141), a shift instruction to the power saving mode is output to the power supply control unit 20 (S105). After S105, the power saving mode shift process is ended. On the other hand, if the shift instruction to the power saving mode is received, the power supply control unit 20 interrupts the power supply to the image forming unit 10, the control unit 30, the operation panel 40, the image reading unit 70, and the external interface, and makes the printer 100 shift from the power supply mode to the power saving mode.

As described above, for example, the gamma correction value (an example of the second correction value) is a value that is obtained by executing the developing bias correction (an example of the first correction process) and the gamma correction (an example of the second correction process). In the printer 100, in case that the shift condition to the power saving mode is met when the execution condition (an example of the first execution condition) of the developing bias correction and the execution condition (an example of the second execution condition) of the gamma correction are met and when the developing bias correction has started, acquiring of the correction value through completion of the gamma correction which is executed before shifting to the power saving mode can reduce the number of executions of the developing bias correction and the waste, as compared with a case where the developing bias correction is re-performed after the printer returns to the power supply mode without completing the gamma correction before shifting to the power saving mode. Further, since the power saving mode is not provided between the developing bias correction and the gamma correction, the relationship between the both correction processes is to be strong, and the obtained gamma correction value has high reliability. Accordingly, the printer 100 shifts to the power saving mode after completion of the gamma correction process. That is, since the printer shifts to the power saving mode after completing all of the correction processes of the correction processing group, the waste of the correction process is suppressed, and the correction value having high reliability is obtained as well.

In the above described printer, the first correction process may be a correction process to acquire a correction value of a density, and the second correction process may be a correction process to acquire a correction value of a misregistration amount of an image forming position. In detecting the misregistration of the image forming position, it is a premise that the mark for detection is accurately detected. Accordingly, by acquiring the correction value of the amount of misregistration after the density is adjusted, the improvement of accuracy of the correction value of the amount of misregistration can be expected.

In the above described printer, the first correction process may be a correction process to acquire a correction value of a developing bias, and the second correction process may be a correction process to acquire a gamma correction value. In calculating a gamma correction value, it is a premise that the color tone of each color is accurately detected. Accordingly, by acquiring the gamma correction value after the developing bias is adjusted, the improvement of accuracy of the gamma correction value can be expected.

In the above described printer, the first correction process may be a correction process to acquire a misregistration amount of a dynamic image forming position, and the second correction process may be a correction process to acquire a misregistration amount of a static image forming position. When the amount of static misregistration between colors is acquired after the amount of dynamic misregistration of each color is individually adjusted, an error of the amount of static misregistration accompanied with the amount of dynamic misregistration becomes small. Accordingly, by acquiring the amount of static misregistration after the dynamic misregistration is adjusted, the improvement of accuracy with respect to the correction value of the amount of static misregistration can be expected.

In the above described printer, the processor may execute a third correction process, which is not included in the correction processing group and is corresponding with the developing bias correction or the gamma correction in the above description, to acquire a third correction value for adjusting the printing properties of the printing unit in case that a third execution condition is met, and the processor may control, in case that the shift condition is met when the first execution condition, the second execution condition, and the third execution condition are met and when the third correction process is being executing and the execution of the first correction process does not start, the printer to shift to the power saving mode without executing the first correction process and the second correction process. If the execution of the first correction process does not start although the first execution condition and the second execution condition are met, waste of the first correction process and the second correction process does not occur. Accordingly, shifting to the power saving mode without performing the first correction process and the second correction process contributes to the early shift to the power saving mode.

In the above described printer, the processor may execute the third correction process, which is not included in the correction processing group and is corresponding with the developing bias correction or the gamma correction in the above description, to acquire the third correction value for adjusting the printing properties of the printing unit in case that the third execution condition is met, and the processor may control, in case that the shift condition is met when the first execution condition, the second execution condition, and the third execution condition are met and when the first correction process starts and the third correction process does not start, control the printer to shift to the power saving mode without making the printer execute the third correction process after completion of the second correction process. If the execution of the correction processing group starts and the third correction process that is independent of the correction processing group does not start, waste of the third correction process does not occur. Accordingly, shifting to the power saving mode without starting the third correction process contributes to the early shift to the power saving mode.

The illustrative embodiment as described above is merely exemplary, and this disclosure is not limited thereto. Accordingly, various corrections and modifications are possible within the range that does not depart from the scope of this disclosure. For example, the printer is not limited to a printer, and may be any one of a copy machine, a fax device, and a multifunction peripheral, which has the printing function. Further, the printing type is not limited to the electrophotographic type, but may be an ink jet type. Further, the printer is not limited to a color printer, but may be a printer for exclusive use of the monochrome.

In the illustrative embodiment, as the modes indicating the power supply state, two modes including the power supply mode and the power saving mode are provided. However, three or more modes may be provided. For example, the power supply mode (mode in which power is supplied to all the power system) is set as a ready mode, and between the ready mode and the power saving mode, a sleep mode may be provided, in which the power supply to the image forming unit 10 is interrupted, but the power supply to the control unit 30 or the interface continues.

Figure 10:
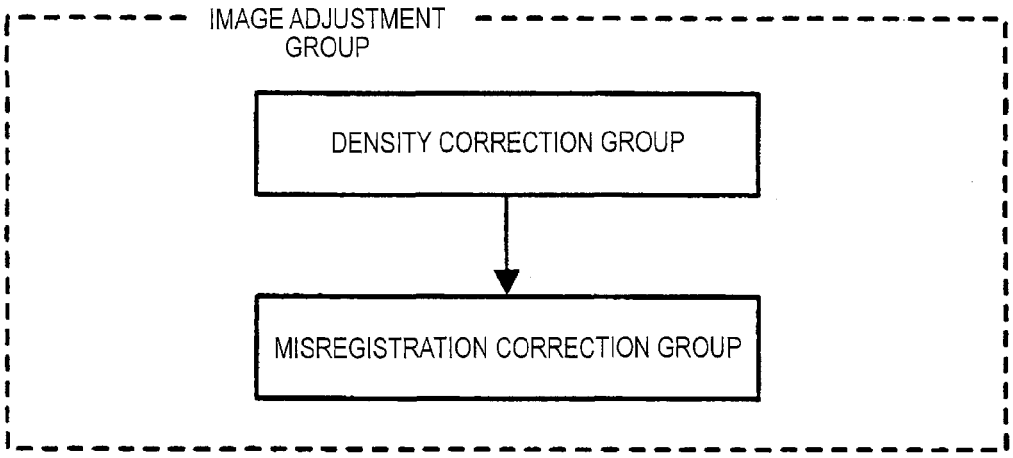
FIG. 10 is a diagram illustrating a priority of correction processes and a group (part 2).

In the illustrative embodiment, the density correction group and the misregistration correction group has an independent relationship. However, as illustrated in FIG. 10, the density correction group and the misregistration correction group may be a set. As described above, unless a mark with sufficient density is formed, the mark for misregistration may not be detected. Accordingly, in the case of executing the misregistration correction group, it is preferable to execute the density correction group as a set and to execute the density correction group prior to the misregistration correction group.

In the illustrative embodiment, as the precondition of the static misregistration correction, the dynamic misregistration correction is executed and the static misregistration correction and the dynamic misregistration correction should be executed as a set. However, the static misregistration correction may be independently executed. That is, the static misregistration correction may not configure a set with the dynamic misregistration correction.

The processes disclosed in the illustrative embodiment may be executed by a single CPU, a plurality of CPUs, hardware of ASIC, or a combination thereof. Further, the processes disclosed in the illustrative embodiment may be realized in various aspects, such as a recording medium recorded with a program or a method for executing the processes.

What is claimed is:

1. A printer comprising:

a printing unit configured to print an image on a sheet;

a processor; and memory storing instructions that, when executed by the processor, causing the printer to perform operations comprising:

supplying power to respective component of the printer in a power supply mode and reducing power consumption in a power saving mode relative to in the power supply mode;

shifting from the power supply mode to the power saving mode in case that a shift condition from the power supply mode to the power saving mode is met;

executing a correction processing group that includes a first correction process to acquire a first correction value for adjusting printing properties of the printing unit in case that a first execution condition is met, and a second correction process to acquire a second correction value for adjusting the printing properties of the printing unit in case that a second execution condition is met after the execution of the first correction process is completed; and delaying the shifting from the power supply mode to the power saving mode until completion of the second correction process, in case that the shift condition is met, when the first execution condition and the second execution condition are met and when the execution of the first correction process has started and the execution of the second correction process is not completed.

2. The printer according to claim 1, wherein the first correction process is a correction process to acquire a correction value of a density, and wherein the second correction process is a correction process to acquire a correction value of a misregistration amount of an image forming position.

3. The printer according to claim 1, wherein the first correction process is a correction process to acquire a correction value of a developing bias, and wherein the second correction process is a correction process to acquire a gamma correction value.

4. The printer according to claim 1, wherein the first correction process is a correction process to acquire a misregistration amount of a dynamic image forming position, and wherein the second correction process is a correction process to acquire a misregistration amount of a static image forming position.

5. The printer according to claim 1, wherein the operations further comprises executing a third correction process, which is not included in the correction processing group, to acquire a third correction value for adjusting the printing properties of the printing unit in case that a third execution condition is met, and wherein the operations further comprises shifting to the power saving mode without executing the first correction process and the second correction process, in case that the shift condition is met, when the first execution condition, the second execution condition, and the third execution condition are met and when the third correction process is being executing and the execution of the first correction process has not started.

6. The printer according to claim 1, wherein the operations further comprises executing a third correction process, which is not included in the correction processing group, to acquire a third correction value for adjusting the printing properties of the printing unit in case that a third execution condition is met, and wherein the operations further comprises shifting to the power saving mode without executing the third correction process after completion of the second correction process, in case that the shift condition is met, when the first execution condition, the second execution condition, and the third execution condition are met and when the first correction process has started and the third correction process has not started.

7. A printer comprising:

a printing device configured to print an image on a sheet;

a control device configured to:

supply power to respective component of the printer in a power supply mode and reduce power consumption in a power saving mode relative to in the power supply mode;

shift from the power supply mode to the power saving mode in case that a shift condition from the power supply mode to the power saving mode is met;

execute a correction processing group that includes a first correction process to acquire a first correction value for adjusting printing properties of the printing unit in case that a first execution condition is met, and a second correction process to acquire a second correction value for adjusting the printing properties of the printing unit in case that a second execution condition is met after the execution of the first correction process is completed; and delay the shifting from the power supply mode to the power saving mode until completion of the second correction process, in case that the shift condition is met, when the first execution condition and the second execution condition are met and when the execution of the first correction process has started and the execution of the second correction process is not completed.

8. A printer comprising:

a print unit configured to form an image on a sheet;

a first control device configured to:

supply a first amount of power to respective components of the printer in a power supply mode;

supply a second amount of power to respective components of the printer in a power saving mode, the second amount of power being less than the first amount of power; and change from the power saving mode to the power supply mode when a power switch is operated;

a second control device configured to:

execute a correction processing group that includes a first correction process to acquire a first correction value for adjusting printing properties of the printing unit in case that a first execution condition is met, and a second correction process to acquire a second correction value for adjusting the printing properties of the printing unit in case that a second execution condition is met after the execution of the first correction process is completed; and delay the shifting from the power supply mode to the power saving mode until completion of the second correction process, in case that the shift condition is met, when the first execution condition and the second execution condition are met and when the execution of the first correction process has started and the execution of the second correction process is not completed.

* * * * *